US012256822B2

(12) United States Patent
Fernandez et al.

(10) Patent No.: US 12,256,822 B2
(45) Date of Patent: Mar. 25, 2025

(54) BARREL FOR HAIR STYLING APPLIANCE

(71) Applicant: Jemella Limited, London (GB)

(72) Inventors: Marcos Fernandez, London (GB); Timothy Moore, London (GB); Anthony Sargeant, London (GB)

(73) Assignee: Jemella Limited, London (GB)

( * ) Notice: Subject to any disclaimer, the term of this patent is extended or adjusted under 35 U.S.C. 154(b) by 0 days.

(21) Appl. No.: 16/694,336

(22) Filed: Nov. 25, 2019

(65) Prior Publication Data

US 2020/0163428 A1 May 28, 2020

Related U.S. Application Data

(63) Continuation of application No. 16/610,380, filed as application No. PCT/GB2018/051197 on May 3, 2018.

(30) Foreign Application Priority Data

May 3, 2017 (GB) ..... 1707061

(51) Int. Cl.
*A45D 1/04* (2006.01)
*A45D 1/16* (2006.01)
(Continued)

(52) U.S. Cl.
CPC ..... *A45D 24/08* (2013.01); *A45D 1/04* (2013.01); *A45D 1/16* (2013.01); *A45D 1/28* (2013.01);
(Continued)

(58) Field of Classification Search
CPC ... A45D 1/04; A45D 1/16; A45D 1/28; A45D 2/36; A45D 2001/004; A45D 24/08
See application file for complete search history.

(56) References Cited

U.S. PATENT DOCUMENTS 1,477,602 A 12/1923 Maurice
4,354,092 A 10/1982 Manabe et al.
(Continued)

FOREIGN PATENT DOCUMENTS

CN 1694631 11/2005
CN 2783682 5/2006
(Continued)

OTHER PUBLICATIONS

"European Application Serial No. 19215028.2, Extended Search Report mailed Mar. 20, 2020", (Mar. 20, 2020), 7 pgs.
(Continued)

*Primary Examiner* — Rachel R Steitz
(74) *Attorney, Agent, or Firm* — Merchant & Gould P.C.

(57) ABSTRACT

A barrel for a hair styling appliance, the barrel comprising: an external surface; and a heater-mounting surface inside the barrel; wherein the heater-mounting surface is integrally formed with the external surface. For example, the barrel may be formed as a single extruded metal component. Also provided is a barrel assembly comprising such a barrel, and one or more heater elements mounted on the heater-mounting surface. Also provided is a hair styling appliance (e.g. a curling tong, curling wand or hot iron brush) comprising such a barrel assembly. A heater element for a hair styling appliance is also provided, the heater element comprising a substrate having a conductive track for generating heat upon application of an electrical current thereto, and an integral temperature sensor. Manufacturing methods in respect of the above are also provided.

32 Claims, 5 Drawing Sheets

(51) Int. Cl.

| | |
|---|---|
| ***A45D 1/28*** | (2006.01) |
| ***A45D 2/36*** | (2006.01) |
| ***A45D 24/08*** | (2006.01) |
| *A45D 1/00* | (2006.01) |
| *A45D 24/00* | (2006.01) |

(52) U.S. Cl.
CPC ..... *A45D 2/36* (2013.01); *A45D 2001/002* (2013.01); *A45D 2001/004* (2013.01); *A45D 2024/002* (2013.01)

(56) References Cited

U.S. PATENT DOCUMENTS

| | | | | |
|---|---|---|---|---|
| 6,911,627 | B2 | 6/2005 | Oguma et al. | |
| 8,794,831 | B2 | 8/2014 | Coursey et al. | |
| 2004/0222210 | A1 | 11/2004 | Lin et al. | |
| 2005/0145617 | A1* | 7/2005 | McMillin | H05B 3/28 219/544 |
| 2007/0119844 | A1* | 5/2007 | Lo | A45D 4/16 219/225 |
| 2008/0035167 | A1 | 2/2008 | Chan | |
| 2011/0174331 | A1* | 7/2011 | Kim | A45D 1/06 132/229 |
| 2011/0203606 | A1 | 8/2011 | Recchion et al. | |
| 2013/0248511 | A1* | 9/2013 | Wallinger | H05B 1/0294 219/510 |
| 2013/0319452 | A1* | 12/2013 | Joo | A45D 2/001 132/223 |
| 2015/0334776 | A1 | 11/2015 | Kumazawa | |
| 2015/0335120 | A1* | 11/2015 | Moore | A45D 1/04 132/211 |
| 2017/0188681 | A1* | 7/2017 | Leung | H05B 3/265 |
| 2020/0146418 | A1 | 5/2020 | Fernandez et al. | |

FOREIGN PATENT DOCUMENTS

| | | | | |
|---|---|---|---|---|
| CN | 2933108 | | 8/2007 | |
| CN | 101744444 | | 6/2010 | |
| CN | 101982010 | | 2/2011 | |
| CN | 103228170 | | 7/2013 | |
| CN | 104643506 | | 5/2015 | |
| CN | 204378236 | U | 6/2015 | |
| CN | 105722422 | | 6/2016 | |
| DE | 202006000670 | | 5/2007 | |
| EP | 0021224 | A1 | 1/1981 | |
| EP | 2106195 | A1 | 9/2009 | |
| EP | 2820915 | | 1/2015 | |
| GB | 1501580 | A | 2/1978 | |
| GB | 2477834 | | 8/2011 | |
| GB | 2477834 | A * | 8/2011 | |
| JP | 01121628 | A | 5/1989 | |
| JP | H09148053 | | 6/1997 | |
| JP | 11214127 | | 8/1999 | |
| JP | 2001037528 | | 2/2001 | |
| JP | 2003243133 | | 8/2003 | |
| JP | 2008243990 | | 10/2008 | |
| JP | 2017117525 | | 6/2017 | |
| KR | 200331242 | Y1 | 10/2003 | |
| KR | 20120007813 | | 1/2012 | |
| KR | 200461720 | | 8/2012 | |
| KR | 101608454 | B1 | 4/2016 | |
| WO | WO-2004102076 | A2 | 11/2004 | |
| WO | WO-2007029981 | A1 * | 3/2007 | H05B 3/141 |
| WO | 2013130593 | | 9/2013 | |
| WO | 2014183289 | | 11/2014 | |
| WO | WO-2015012765 | A1 | 1/2015 | |
| WO | 2018203077 | | 11/2018 | |

OTHER PUBLICATIONS

"Australian Application Serial No. 2019271875, Office Action mailed Jun. 22, 2020", (Jun. 22, 2020), 6 pgs.
U.S. Appl. No. 16/610,380, filed Nov. 1, 2019, Barrel for Hair Styling Appliance.
"United Kingdom Application Serial No. 1707061.6, Office Action mailed Aug. 13, 2021", (Aug. 13, 2021), 7 pgs.
"U.S. Appl. No. 16/610,380, Preliminary Amendment filed Nov. 20, 2019", 5 pgs.
"International Application No. PCT/GB2018/051197, International Search Report and Written Opinion mailed Jul. 4, 2018", (Jul. 4, 2018), 11 pgs.
"United Kingdom Application GB1707061.6, Search Report Under Section 17 dated Jul. 27, 2017", (Jul. 27, 2017), 2 pgs.
"U.S. Appl. No. 16/610,380, Non Final Office Action mailed Oct. 20, 2021", 7 pgs.
"Chinese Application Serial No. 201880044695.X, Office Action mailed Dec. 2, 2021", w English Translation, 18 pgs.
"European Application Serial No. 20190215028, Third Party Observation mailed Oct. 22, 2021", 1 pg.
"Advanced Ceramic Heater Thermal Solutions", Durex Industries, (2016), 4 pgs.
"European Application Serial No. 19215028.2, Office Action mailed Nov. 16, 2021", 7 pgs.
"Australian Application Serial No. 2019271875, Opposition—Statement of Grounds and Particulars mailed Jan. 10, 2022", (Jan. 10, 2022), 15 pgs.
"Chinese Application Serial No. 202010063954.2, Office Action mailed Jan. 24, 2022", w Concise Statement of Relevance, (Jan. 24, 2022), 7 pgs.
Forsythe, W E, "The Properties of Tungsten and the Characteristics of Tungsten Lamps", American Astronomical Society NASA Astrophysics Data System, (Sep. 1, 1924), 40 pgs.
"U.S. Appl. No. 16/610,380, Final Office Action mailed Jun. 9, 2022", 9 pgs.
"FHI Heat Promotion from the you tube video", [Online]. Retrieved from the Internet: URL: https: www.youtube.com watch?v= yzX660Z9yL4, (Sep. 20, 2016), 1 pg.
"Facebook.com FH Heat", [Online]. Retrieved from the Internet: URL: http: facebook.com fhiheat photos a. 10151923067389523 10152626282124523, (Jun. 2, 2014), 1 pg.
"Product Review Prettyconnected.com", [Online]. Retrieved from the Internet: URL: https: protect-us.mimecast.com s hdmpCM8o53f5N2njFJOxTN?domain=prettyconnected.com , (May 28, 2013), 2 pgs.
"The T3 BodyWaver-Create a salon-worthy blow dried look at home by CURRENTBODY", [Online]. Retrieved from the Internet: URL: https: www.youtube.com watch?v=0aPauj-b_k, (Apr. 20, 2015), 1 pg.
"Body Waver", [Online]. Retrieved from the Internet: URL: https: protect-us.mimecast.com s DyujCQWv59S60Xw7H9sfnU?domain= web.archive.org, (Jul. 3, 2014), 2 pgs.
"MCH-Alumina Ceramic Heater", [Online]. Retrieved from the Internet: URL: http: www.europages.com filestore gallery b9 16 11086999_b2a9723d.pdf, (Nov. 6, 2015), 5 pgs.
"How too repair loose flat iron plate", [Online]. Retrieved from the Internet: URL: How too repair loose flat iron plate which can be seen athttps: www.youtube.com watch?v=STJdhr4yVcl, (Dec. 4, 2010), 1pg.
"Another GHD5 repaired in real time", [Online]. Retrieved from the Internet: URL: https: www.youtube.com watch?v=bAbkSmMnORU, (Jun. 30, 2016), 2 pgs.
"Thermal Paste", [Online]. Retrieved from the Internet: URL: http: web.archive.org web 20151120203827 www.ghd-repair.co.uk faq thermal_paste.html, (Nov. 20, 2015), 1 pg.
"Heater Element Problems", [Online]. Retrieved from the Internet: URL: https: protect-us.mimecast.com s F1kaCYE0I3S3rDy5FrnoFw? domain=web.archive.org, (Nov. 15, 2015), 1 pg.
"GHD Heater For MK3 Series", [Online]. Retrieved from the Internet: URL: https: protect-us.mimecast.com s h4MICZ6pm7iMJ7WzFVS6i9?domain=ghdrepairs.com, (Mar. 17, 2012), 2 pgs.
Katz, Amber, "Finest Hour Series: Hair", [Online]. Retrieved from the Internet: URL: http: www.rouge18.com Apr. 2, 2013 finest-hour-series-hair , (Apr. 2, 2013), 1 pg.

(56) References Cited

OTHER PUBLICATIONS

"U.S. Appl. No. 16/610,380, Response filed Feb. 22, 2022 to Non Final Office Action mailed Oct. 20, 2021", 13 pgs.
"United Kingdom Application Serial No. 2117718.3, Search and Examination Report dated Dec. 23, 2021", (Dec. 23, 2021), 7 pgs.
"Chinese Application Serial No. 202010063954.2 Office Action mailed Aug. 15, 2022", w English Translation, 15 pgs.
"U.S. Appl. No. 16/610,380, Response filed Dec. 7, 2022 to Final Office Action mailed Jun. 9, 2022", 10 pgs.
"U.S. Appl. No. 16/610,380, Non Final Office Action mailed Feb. 14, 2023", 9 pgs.
Ikebe, "", Machine translation of JP 2001037528, 11 pgs.
"Alumina Heaters—Kyocera Fine Ceramics (Advanced Ceramics)", [Online]. Retrieved from the Internet: <URL: http://web.archive.org/web/20160507005116/http://global.kyocera.com:80/prdct/fc/product/material/alumina/heater016.html>, (May 7, 2016), 8 pgs.
"U.S. Appl. No. 16/610,380, Response filed Jun. 14, 2023 to Non Final Office Action mailed Feb. 14, 2023", 14 pgs.
"Applications—Kyocera Fine Ceramics (Advanced Ceramics)", [Online]. Retrieved from the Internet: <URL: http://web.archive.org/web/20170304133713/http://global.kyocera.com/prdct/fc/list/use/index.html>, (Mar. 4, 2017), 5 pgs.
"High Performance Ceramic Heaters", [Online]. Retrieved from the Internet: <http://web.archive.org/web/20160320185034/https://oasismaterials.com/>, (Mar. 20, 2016), 2 pgs.
"Ordering Process—Kyocera Fine Ceramics (Advanced Ceramics)", [Online]. Retrieved from the Internet: <URL: http://web.archive.org/web/20160716235448/https://global.kyocera.com/prdct/fc/how_to/index.html>, (Jul. 16, 2016), 3 pgs.
"The Advantages of Ceramic Heaters—Kyocera Americas", [Online]. Retrieved from the Internet: <URL: https://www.yumpu.com/en/document/read/7108188/theadvantages-of- ceramic-heaters-kyocera-americas>, (Accessed May 3, 2023), 5 pgs.
Product Information Sheet for "Aluminum Nitride Ceramic Heaters", Durex Industries, [Online]. Retrieved from the Internet: <URL: https://web.archive.org/web/20170306181414/http:/durexindustries.com/aluminum-nitride-and-alumina-ceramic-heaters>, accessed Mar. 6, 2017.

* cited by examiner

BARREL FOR HAIR STYLING APPLIANCE

CLAIM FOR PRIORITY

This application is a continuation of U.S. application Ser. No. 16/610,380, filed Nov. 1, 2019, which is a U.S. national stage filing under 35 U.S.C. § 371 from International Application No. PCT/GB2018/051197, filed on 3 May 2018, and published as WO2018/203077 on 8 Nov. 2018, which claims the benefit under 35 U.S.C. 119 to United Kingdom Application No. GB 1707061.6, filed on 3 May 2017, the benefit of priority of each of which is claimed herein, and which applications and publication are hereby incorporated herein by reference in their entireties.

FIELD OF THE INVENTION

The present invention relates to a heatable barrel for a hair styling appliance such as, but not limited to, a curling tong, curling wand, or hot iron brush; and to associated components and manufacturing methods.

BACKGROUND TO THE INVENTION

Certain hair styling appliances, such as curling tongs, curling wands, and hot iron brushes, include an elongated barrel component and an electrical heater element operable to heat the barrel.

In existing hair styling appliances of this kind, the barrel typically consists of a simple cylindrical metal tube. In manufacturing the appliance, a heater element is mounted within the barrel by means of a separate heater carrier. In more detail, the heater element is mounted on or in the heater carrier, and then the heater carrier is fitted inside the barrel, adjacent to the inner surface of the barrel. Consequently, in use, thermal transfer of heat from the heater element to the barrel is across at least two boundaries—firstly, from the heater element to the heater carrier, and secondly, from the heater carrier to the barrel.

With such hair styling appliances there is a desire to increase the speed and efficiency of thermal transfer from a surface of an internal heater element to an external surface of the appliance, in order to transfer heat more quickly and efficiently to the hair being styled.

SUMMARY OF THE INVENTION

According to a first aspect of the present invention there is provided a barrel for a hair styling appliance, the barrel comprising: an external surface; and a heater-mounting surface inside the barrel; wherein the heater-mounting surface is integrally formed with the external surface.

By virtue of the heater-mounting surface being integrally formed with the external surface, this creates an uninterrupted path for the transfer of heat from a heater element (when mounted on the heater-mounting surface) to the external surface. In turn, this gives rise to an increase in the speed and efficiency of thermal transfer from the heater element to the external surface of the appliance, and thence to the hair being styled.

A further advantage conferred by the heater-mounting surface being integrally formed with the external surface is that the manufacturing process is simplified, as a separate heater carrier component is not required.

The heater-mounting surface may extend across the inside of the barrel, from one side to the other. For example, the heater-mounting surface may be located substantially across a diameter of the barrel. Alternatively the heater-mounting surface may be located away from a diameter of the barrel (e.g. to provide more space to accommodate a larger heater element).

Advantageously the thickness of the heater-mounting surface may be approximately twice the thickness of the external surface, as this has been found to improve the effectiveness of the heat transfer from the heater element to the external surface.

The heater-mounting surface may be substantially flat. Alternatively it may incorporate a longitudinal recess for receiving one or more heater elements, thereby facilitating the accurate positioning and retention of the heater element(s) on the heater-mounting surface.

The external surface may have a circular cross-section, or an elliptical cross-section, or, if so desired, some other shape.

Advantageously, the barrel (with the integral heater-mounting surface) may be formed as a single extruded component, for example from metal. This greatly facilitates manufacture of the barrel, giving rise to lower production costs. Furthermore, this enables the barrel to be any desired length, or for a range of barrel lengths to be readily produced.

According to a second aspect of the present invention there is provided a barrel assembly for a hair styling appliance, the barrel assembly comprising a barrel in accordance with the first aspect of the invention, and one or more heater elements mounted on the heater-mounting surface.

If the heater-mounting surface incorporates a longitudinal recess then the or each heater element may be mounted within said longitudinal recess.

The barrel assembly may further comprise means for securing the or each heater element against the heater-mounting surface. In one example said means for securing comprises a spring clip. However, alternative securing means may be used instead.

According to a third aspect of the present invention there is provided a hair styling appliance comprising a barrel assembly in accordance with the second aspect of the invention. The hair styling appliance may be any type that uses one or more heated barrel components. For example, the hair styling appliance may be selected from a group comprising: a curling tong, a curling wand, and a hot iron brush.

For use in a barrel assembly as described above, or in other pieces of hair styling equipment not employing such a barrel assembly, a fourth aspect of the present invention provides a heater element comprising a substrate (e.g. made of ceramic) having a conductive track for generating heat upon application of an electrical current thereto (i.e. by Joule heating), and an integral temperature sensor.

For example, the conductive track and the temperature sensor may be formed as parallel layers embedded within the substrate. The temperature sensor may comprise a resistive track, the resistance of which changes with temperature. Consequently, the temperature can be sensed over an area, not just a point, and the track can advantageously be molecularly bonded to the heater, thus removing any need for thermal paste (which is difficult in manufacture and thermally resistive, such that it would reduce performance).

According to a fifth aspect of the present invention there is provided a method of manufacturing a barrel for a hair styling appliance, the method comprising extruding the barrel such that it comprises an external surface and an integrally-formed heater-mounting surface inside the barrel.

Optional features of the manufacturing method are as described above in relation to the first aspect of the invention.

The method may subsequently comprise mounting one or more heater elements on the heater-mounting surface.

The method may further comprise securing the or each heater element against the heater-mounting surface.

According to a sixth aspect of the present invention there is provided a method of forming a heater element for a hair styling appliance, the method comprising forming, on or in a substrate, a conductive track for generating heat upon application of an electrical current thereto, and an integral temperature sensor.

The conductive track and the temperature sensor may be formed as parallel layers embedded within the substrate.

The temperature sensor may comprise a resistive track, the resistance of which changes with temperature.

The temperature sensor may be molecularly bonded to the substrate.

The substrate may comprise a ceramic material.

BRIEF DESCRIPTION OF THE DRAWINGS

Embodiments of the invention will now be described, by way of example only, and with reference to the drawings in which.

In the figures, like elements are indicated by like reference numerals throughout.

DETAILED DESCRIPTION OF PREFERRED EMBODIMENTS

The present embodiments represent the best ways known to the Applicant of putting the invention into practice. However, they are not the only ways in which this can be achieved.

Overview

Figure 1:
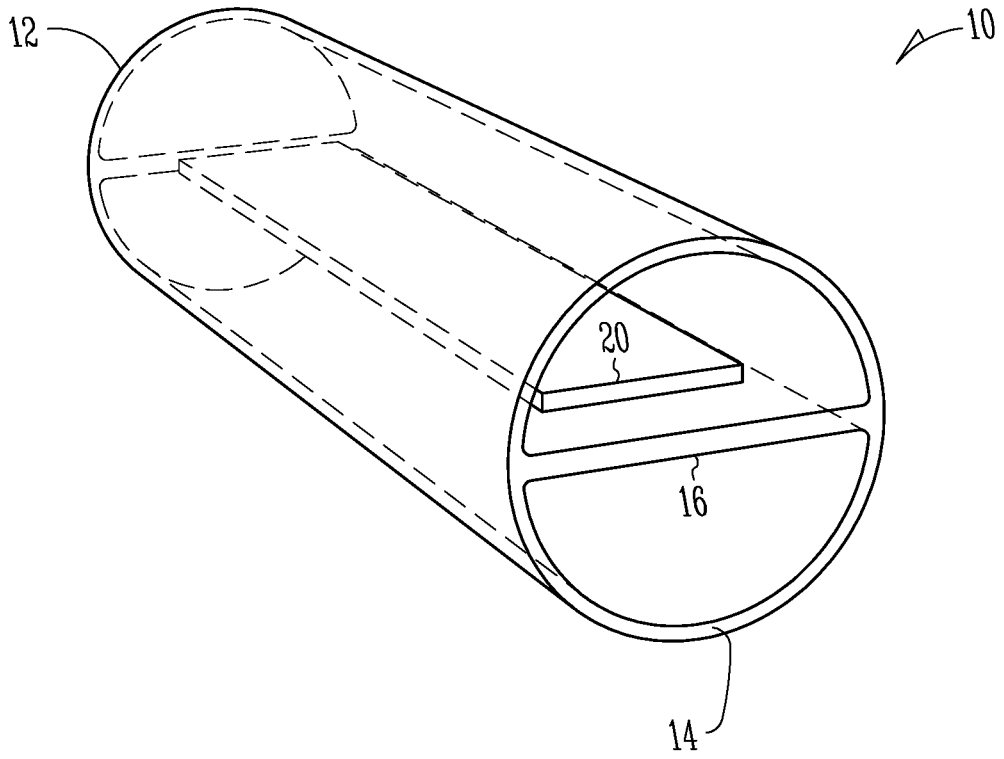
FIG. 1 is a perspective view of a barrel of a hair styling appliance having an integral heater-mounting surface with a heater element mounted thereon.
Figure 2:
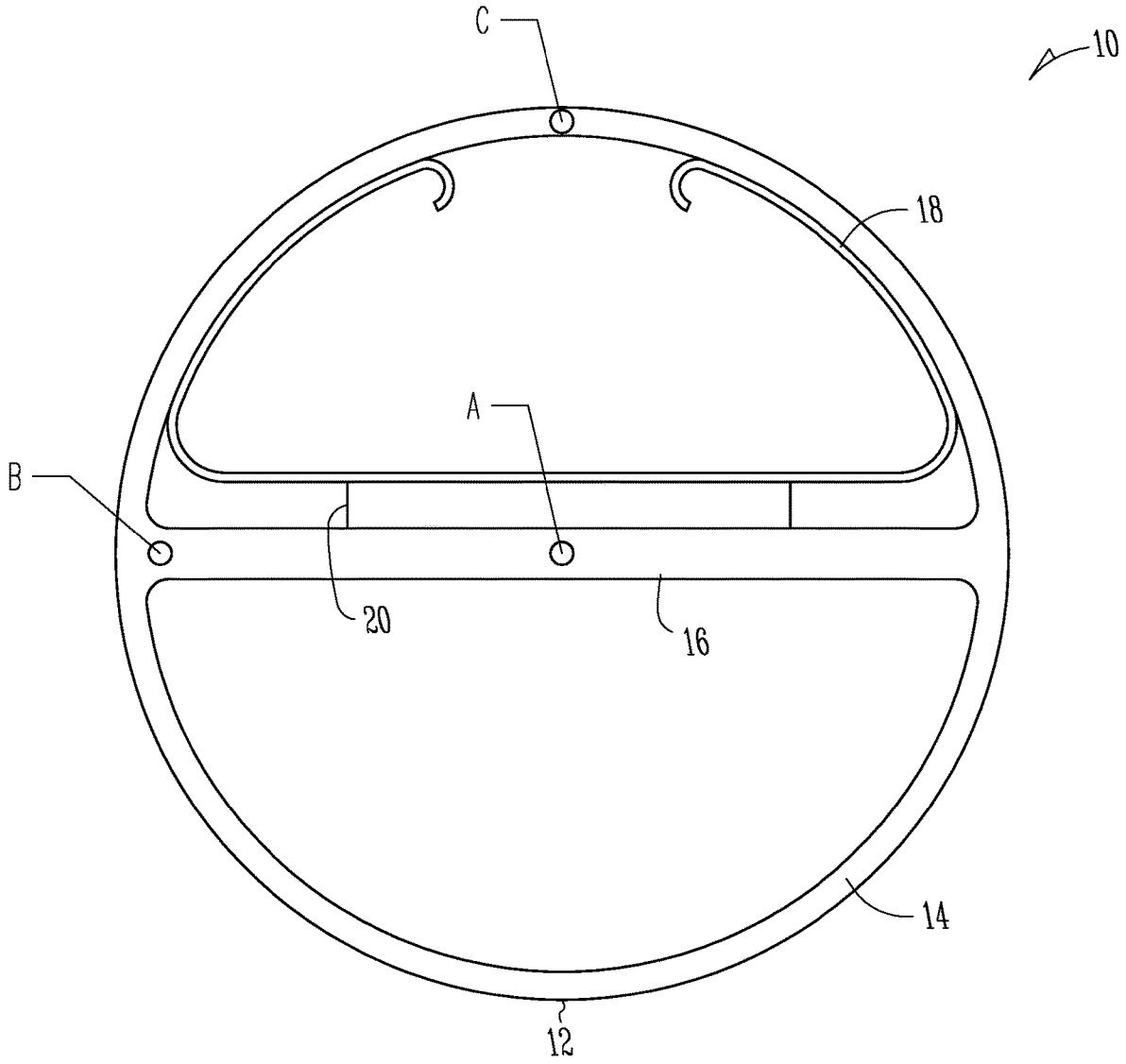
FIG. 2 is a cross-sectional view (with possible dimensions by way of example only) of the barrel of FIG. 1, again with a heater element mounted on the integral heater-mounting surface, and also showing a spring clip arranged to hold the heater element in place against the heater-mounting surface.
Figure 3:
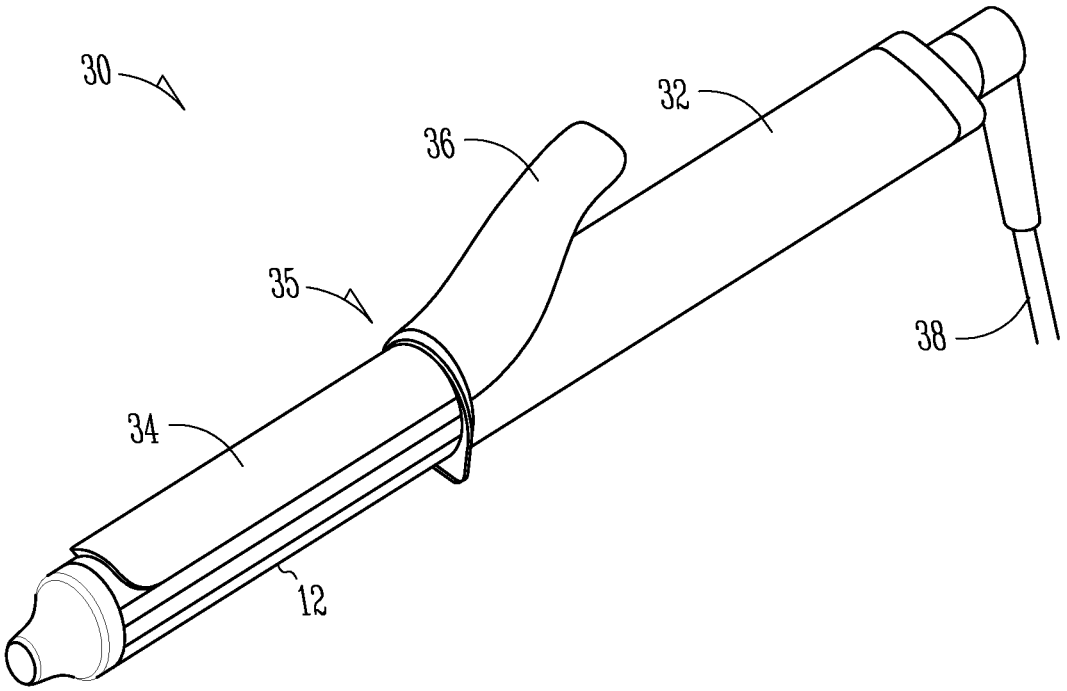
FIG. 3 is an example of a hair styling appliance—in this case, a curling tong—incorporating a heated barrel of the form shown in FIGS. 1 and 2.

FIGS. 1 and 2 show, in perspective and cross-sectional views respectively, an assembly 10 that may form part of a hair styling appliance such as a curling tong (e.g. as illustrated in FIG. 3), a curling wand, or a hot iron brush. The assembly 10 comprises an elongate barrel 12 that, in use, may be used to heat and style hair. The barrel 12 has a curved external surface 14 and an integral internal heater-mounting surface 16. The assembly 10 further comprises one or more heater elements 20 mounted on the heater-mounting surface 16. As illustrated, the heater element(s) 20 are typically elongate, planar, and relatively thin in form (i.e. having a thin rectangular cross-sectional shape), although other geometries are also possible.

In the illustrated embodiment a spring clip 18 is inserted within the barrel 12 to hold the heater element(s) 20 in place against the heater-mounting surface 16. However, in alternative embodiments other means for securing the heater element(s) 20 in place may be used instead.

Barrel with Integral Heater-Mounting Surface

The barrel 12, with external surface 14 and integral heater-mounting surface 16, is preferably formed as a single extruded metal component. The external surface 14 may, in cross-section, be any desired shape. In our presently-preferred embodiments the external surface 14 has a circular or elliptical cross-sectional shape, although other cross-sectional shapes are also possible.

When viewed in cross section, the integral heater-mounting surface 16 extends as a chord across the inside of the barrel 12, from one side to the other. Thus, the heater-mounting surface 16 is integrally attached to the external surface 14 in two opposing places. In our presently-preferred embodiments the integral heater-mounting surface 16 is situated along (or close to) a diameter of the barrel 12—i.e. passing through or near to the centre of the barrel 12 when viewed in cross-section. However, in alternative embodiments the integral heater-mounting surface 16 may be positioned further away from the diameter of the barrel 12 (for example if the or each heater element 20 is relatively bulky such that more than half the internal cross-sectional area of the barrel 12 is required to accommodate it).

Whilst, in the illustrated embodiment, the integral heater-mounting surface 16 is a flat surface on which the or each heater element 20 is mounted, in alternative embodiments the heater-mounting surface 16 may incorporate a longitudinal recess in which the heater element(s) 20 can be located. Such a longitudinal recess may be readily incorporated in the cross-sectional shape of the extruded metal.

In manufacture, the barrel 12 may be cut from a long or continuous length of extruded metal having a cross-sectional profile that includes the external surface 14 and the integral heater-mounting surface 16. As a consequence of being formed as a single extruded metal component, manufacture of the barrel 12 is facilitated, giving rise to lower production costs. Furthermore, by using an extruded component, this enables the barrel 12 to be any desired length, or for a range of barrel lengths to be readily produced.

Any suitable metal may be extruded to form the barrel 12. For example, the metal may be aluminium, which is relatively inexpensive, has a relatively low density (enabling the resulting product to be relatively light weight), and is easy to extrude.

Thermal Transfer Considerations

The integral heater-mounting surface 16 also serves as an internal feature for the conduction and/or radiation of heat from the heater element(s) 20 to the external surface 14 of the barrel 12.

As shown in FIG. 2, heat transfer from the one or more heater elements 20 is provided by the heater element(s) 20 thermally engaging an adjacent internal surface of the barrel (point A), on the heater-mounting surface 16. Heat is efficiently transmitted from the or each heater element 20 to the external surface 14 (point C) by means of the heater-mounting surface 16 serving as an integral internal feature for the conduction of heat (e.g. via point B) and/or radiation of heat.

With the presently-preferred embodiments, improved efficiency can be achieved by the heater-mounting surface 16 having a thickness (e.g. at point A) that is twice the thickness of the outer external surface 14 (e.g. at point C).

With such a geometry, improved thermal performance has been achieved, as the design and thickness of the integral internal conducting/radiating features (i.e. the heater-mounting surface 16) relative to the thickness of the external surface 14 provides effective heat transfer with minimal temperature difference from the heater element 20 to the external "working" surface 14.

An example of such a geometry is given in FIG. 2, in which possible dimensions are provided by way of example only. In this example, the heater-mounting surface 16 (serving as an internal feature for the conduction and/or radiation of heat) has a thickness (e.g. at point A) of 2 mm, whereas the external surface 14 (e.g. at point C) has a uniform thickness of 1 mm. In passing, it may be noted that, in this example, the barrel 12 has an external diameter of 30 mm (+/−5 mm).

It will of course be appreciated that other geometries are possible in which the thickness of the heater-mounting surface 16 is twice the thickness of the external surface 14. For example, the thickness of the heater-mounting surface 16 may be 3 mm and the thickness of the external surface 14 may be 1.5 mm, or alternatively, the thickness of the heater-mounting surface 16 may be 1.5 mm and the thickness of the external surface 14 may be 0.75 mm.

Spring clip (or other securing means) In the illustrated embodiment the spring clip 18 positions the heater element(s) 20 adjacent to the heater-mounting surface 16 and provides sufficient force to hold the heater element(s) 20 in close contact with the heater-mounting surface 16, thereby enabling effective thermal transfer to take place through the heater-mounting surface 16 and thence to the external surface 14 of the barrel 12.

However, as mentioned above, in alternative embodiments other means for securing the heater element(s) 20 in place against the heater-mounting surface 16 may be used instead.

Example Hair Styling Appliance

FIG. 3 illustrates an example of a hair styling appliance—in this case, a curling tong 30—which incorporates a barrel assembly 10 as described above (i.e. an extruded barrel 12 with an integral heater-mounting surface 16 on which one or more heater elements 20 are mounted). The curling tong 30 includes a main body 32 that is grasped by a user during use. The main body 32 incorporates an electrical power supply (e.g. a mains electricity supply cable 38, or conceivably a rechargeable battery). The barrel 12 is attached to the main body 32 and wired such that electrical power can be provided to the heater element 20 within the barrel 12 (e.g. under the control of a control circuit within the main body 32) and thereby cause the barrel 12 to heat.

A clamp member 34, having a curved profile to complement the external surface 14 of the barrel 12, is pivotally mounted adjacent to the barrel 12 by means of a pivot mechanism 35 and a user-pressable lever 36. As will be familiar to those skilled in the art, the clamp member 34 is spring-biased into a closed position in which the clamp member 34 presses against the barrel 12. With the clamp member 34 in the closed position and the barrel 12 heated, the curling tong 30 can be used to style hair that has been introduced between the clamp member 34 and the barrel 12. However, upon the user pressing on the lever 36, the clamp member 34 pivots about the pivot mechanism 35 and thereby opens, for example to allow hair to be introduced between the barrel 12 and the clamp member 34 for styling, or to release hair once the desired styling operation has been completed.

Improved Heater Architecture

Figure 4:
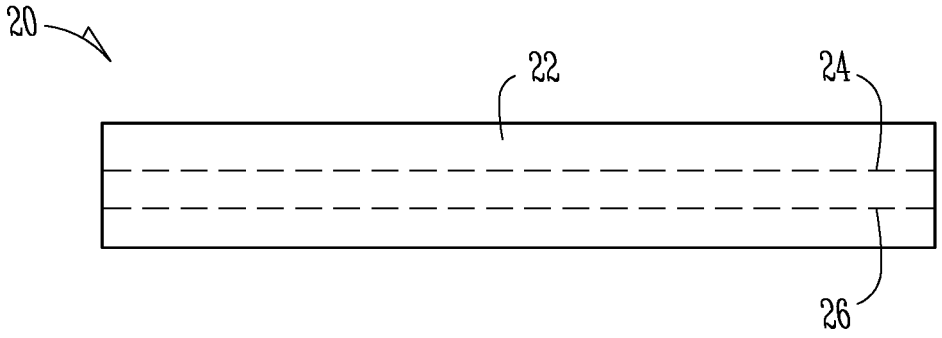
FIG. 4 is a cross-sectional schematic diagram of a heater element having an integral temperature sensor, that may be used within a barrel of the form shown in FIGS. 1 and 2, or in other hair styling appliances that do not have such a barrel.

To improve the thermal response of a hair styling appliance (e.g. curling tong) such as those described above, we have found that it is advantageous not to use a temperature sensor that is separate from the heater element. Rather, as shown in FIG. 4, a temperature sensor may be embedded in the heater element 20 as a secondary layer of resistive track, such that the heater element 20 includes two layers: a heater track layer 26 and a temperature sensor layer 24. In the illustrated embodiment, both the heater track and the temperature sensor are embedded within a ceramic substrate 22 (for example made of aluminium oxide).

The resistive track forming the temperature sensor may have either a positive or a negative temperature coefficient, such that as the temperature is changed the resistance of the track changes, which can then be detected by a control circuit, and hence the temperature can be calculated (once the change in track resistance has been calibrated against temperature). In turn, depending on the calculated temperature, the electrical power supplied to the heater track can be controlled, thereby regulating the temperature of the heater element 20. The benefits of using an embedded temperature sensor track are twofold: the temperature can be sensed over an area, not just a point, and the track can advantageously be molecularly bonded to the heater, thus removing any need for thermal paste (which is difficult in manufacture and thermally resistive, such that it would reduce performance).

The use of such an integrated heater and sensor construction is by no means limited to a hair styling appliance as described above (i.e. one having a barrel 12 formed as a single extruded metal component, with an external surface 14 and an integral heater-mounting surface 16). Indeed, such an integrated heater and sensor construction is more broadly applicable, and can for example be used in other pieces of hair styling equipment, such as hair straighteners, as well as on tri-zone heaters.

Figure 5:
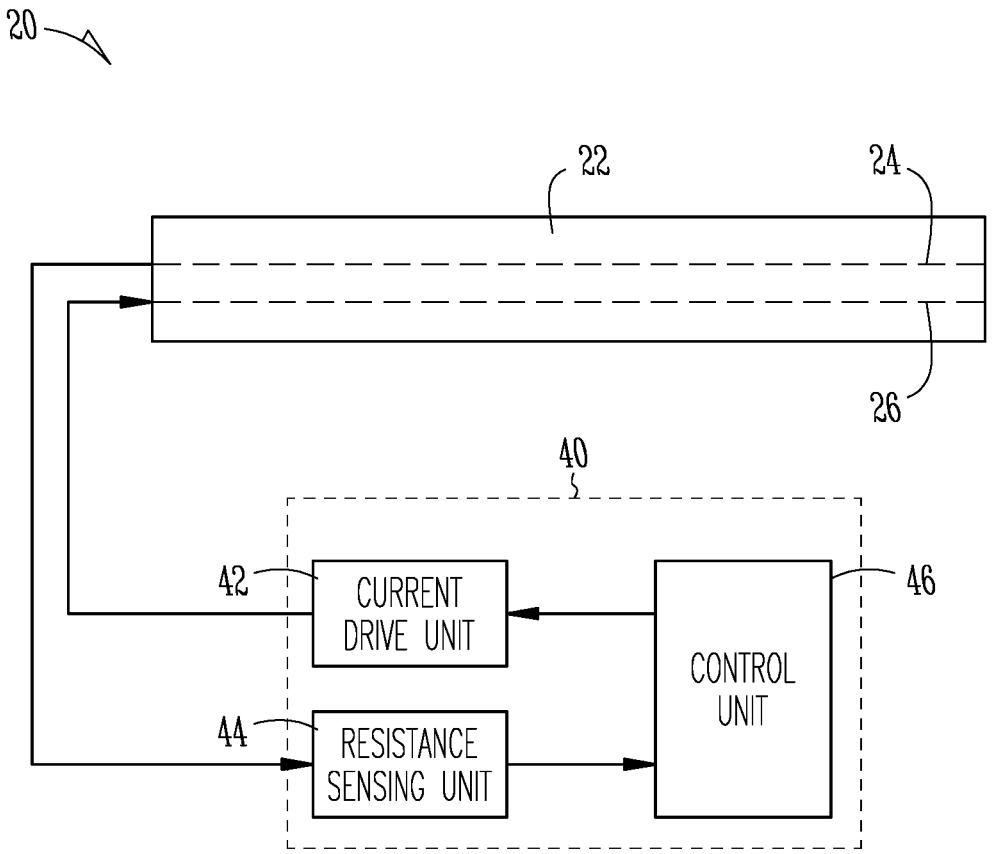
FIG. 5 is a schematic illustration of a control circuit for use with (and shown connected to) the heater element of FIG. 4.

FIG. 5 is a schematic illustration of a control circuit 40 suitable for use with (and shown connected to) the heater element 20 of FIG. 4. The control circuit 40 includes a current drive unit 42 operable to supply electrical current to the heater track layer 26 of the heater element 20, and a resistance sensing unit 44 operable to generate a signal representative of (or dependent on) the resistance of the resistive track of the temperature sensor layer 24. The current drive unit 42 and the resistance sensing unit 44 are both connected to a control unit 46 (e.g. a suitably programmed microprocessor).

In use, the control unit 46 causes the current drive unit 42 to supply electrical current to the heater track layer 26, thus causing the heater element 20 to heat up. In parallel with the operation of the current drive unit 42, the resistance sensing unit 44 generates a signal representative of (or dependent on) the resistance of the resistive track of the temperature sensor layer 24, and supplies this signal to the control unit 46 (i.e. in a feedback manner). The signal generated by the resistance sensing unit 44 may be processed by the control unit 46 to determine the temperature of the heater element 20 (e.g. by employing a calibration relationship), and in turn the control unit 46 is configured to adjust the electrical current supplied to the heater track layer 26, to thereby regulate the temperature of the heater element 20—specifically, such that the heater element 20 reaches and maintains a desired temperature.

A user-adjustable control knob or other user interface (e.g. electronic buttons) may be provided, coupled to the control unit 46, to enable the user to specify the temperature to be attained by the heater element 20. In a first variant the control knob or user interface may enable the user to specify the actual temperature required (e.g. in ° C.). In a second variant the control knob or user interface may enable the user to select whether the temperature is to be "high", "medium" or "low", for example, such settings corresponding to respective predetermined temperatures. In a third variant the control knob or user interface may enable the user to specify the type of hair and/or styling operation to be carried out, upon which the control unit 46 determines (from effectively an internal look-up table) an appropriate temperature to which the heater element 20 is to be heated.

Figure 6:
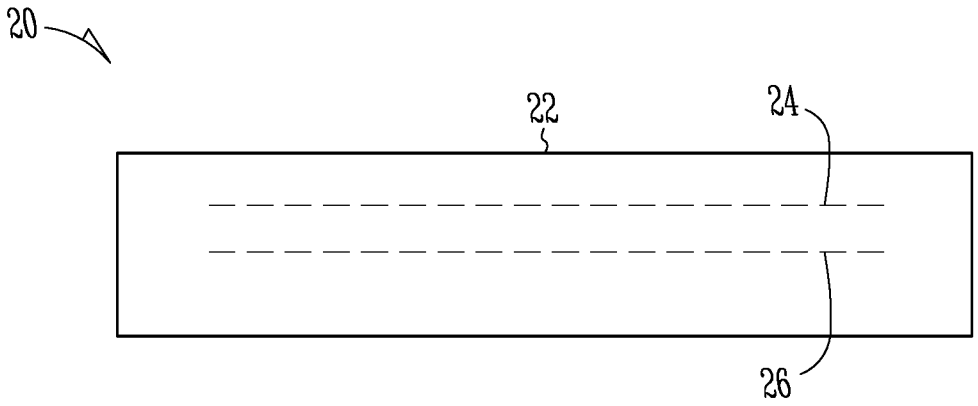
FIG. 6 is another cross-sectional schematic diagram of a heater element having an integral temperature sensor, similar to that of FIG. 4, with possible dimensions by way of example only.

FIG. 6 illustrates another heater element having an integral temperature sensor, similar to that of FIG. 4, with possible dimensions by way of example only. In this case the heater element 20 comprises a ceramic substrate 22 (for example aluminium oxide) having an embedded temperature sensor layer 24 and a heater track layer 26. As discussed in greater detail below, the heater element 20 may be formed from three constituent layers that are joined together.

With reference to the exemplary dimensions given in FIG. 6, the resistive heater track (of layer 26) may be 0.6 mm above the undersurface of the heater element 20 (i.e. the surface which is adjacent to the heater-mounting surface 16 in the case of the assembly illustrated in FIGS. 1 and 2). The resistive track of the temperature sensor (of layer 24) may be 0.2 mm above the resistive heater track, and 0.2 mm beneath the upper surface of the heater element 20.

Further, the resistive track of the temperature sensor (of layer 24) and the resistive heater track (of layer 26) may both be at least 0.6 mm inward of the outer edges of the heater element 20, to prevent undesirable external effects such as short-circuiting or arcing with the heater-mounting surface, or flashover. To explain this in more detail, it will be appreciated that the heater element 20 may operate at a high voltage (e.g. ~240V AC), and the heater-mounting surface may be a metal plate. Hence, there needs to be sufficient insulation between the heater track and the heater-mounting surface to stop electricity jumping between the two, as this could otherwise cause electrocution of the user. Although air is an insulator, it is not a particularly good or reliable one, due to variation in water content (which is especially the case in the context of hair styling). Accordingly, in order to comply with the relevant safety provisions, at least a 0.6 mm gap is provided between the live track (of layer 26) and the heater-mounting surface (e.g. metal plate), to ensure there can be no conduction of electricity between the two.

The overall substrate 22 of the heater element 20 may be formed from three ceramic layers that are fired together (or otherwise joined together). The overall substrate 22 may for example be formed of aluminium oxide, by virtue of the constituent layers also being formed of aluminium oxide.

Figure 7:
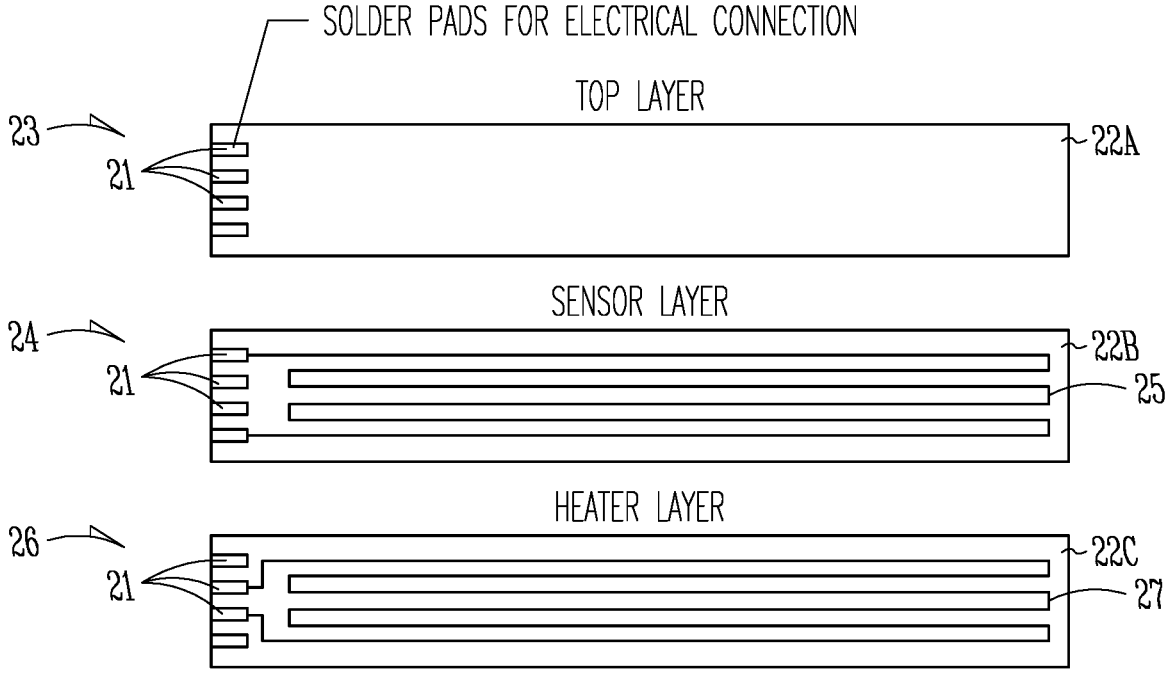
FIG. 7 illustrates, in plan view, examples of constituent layers that may be used to form a heater element having an integral temperature sensor, such as that of FIG. 6.

FIG. 7 illustrates examples of such layers, namely a top layer 23, a temperature sensor layer 24, and a heater track layer 26.

When taken separately, the heater track layer 26 (lowermost in the cross-sectional view of FIG. 6) has its own ceramic substrate 22*c* (e.g. aluminium oxide) on which the resistive heater track 27 is deposited. The resistive heater track 27 preferably has a minimal temperature coefficient (be it positive or negative) to allow for fast heat-up.

Similarly, when taken separately, the temperature sensor layer 24 has its own ceramic substrate 22*b* (e.g. aluminium oxide) on which the resistive track 25 of the temperature sensor is deposited. As mentioned above, the resistive track 25 of the temperature sensor may have either a positive or a negative temperature coefficient, to allow the temperature of the heater to be measured. As illustrated, the pattern of the resistive track 25 of the temperature sensor may correspond with, and be in alignment with, the pattern of the resistive heater track 27, although variants are possible in which this need not be the case.

Similarly, when taken separately, the top layer 23 comprises a ceramic substrate 22*a* (e.g. aluminium oxide).

At one end, the top layer 23 further comprises a series of four through-thickness solder pads 21 for electrical connection to associated circuitry—e.g. to a current drive unit 42 and a resistance sensing unit 44 as illustrated in FIG. 4.

As illustrated, the temperature sensor layer 24 also has a corresponding series of through-thickness solder pads 21, two of which are connected to the resistive track 25 of the temperature sensor.

The heater track layer 26 also has a corresponding series of solder pads 21 (not through-thickness, so as to avoid making electrical contact with the underlying heater-mounting surface 16 in use), two of which are connected to the resistive heater track 27.

The positions of the solder pads 21 on the three layers 23, 24, 26 are in mutual alignment. When the three layers 23, 24, 26 are joined together (e.g. by being fired together), on top of one another, the solder pads 21 on each of the layers 23, 24, 26 come into contact with one another. Moreover, the individual ceramic substrates 22*a*, 22*b*, 22*c* join to form one overall substrate 22.

Subsequently, the solder pads 21 on the top layer 23 are connected to the associated circuitry (e.g. units 42 and 44 as mentioned above). More particularly, the current drive unit 42 is connected to the specific solder pads on the top layer 23 whose positions correspond to the specific solder pads of the heater track layer 26 to which the resistive heater track 27 is connected (i.e. the middle two solder pads as illustrated). Likewise, the resistance sensing unit 44 is connected to the specific solder pads on the top layer 23 whose positions correspond to the specific solder pads of the temperature sensor layer 24 to which the resistive sensor track 25 is connected (i.e. the outermost two solder pads as illustrated).

In an alternative embodiment, the solder pads are not through thickness, but rather the specific solder pads of each layer 24, 26 that are directly connected to a respective track 25, 27 are exposed on the respective layer, to allow electrical connections to be made directly to the respective solder pads. This may be achieved by shaping the ceramic layers such that the solder pads of an underlying ceramic layer's track are not covered by an overlying ceramic layer.

Possible Modifications and Alternatives

Detailed embodiments and some possible alternatives have been described above. As those skilled in the art will appreciate, a number of modifications and further alternatives can be made to the above embodiments whilst still benefiting from the inventions embodied therein. It will therefore be understood that the invention is not limited to the described embodiments and encompasses modifications apparent to those skilled in the art lying within the scope of the claims appended hereto.

For example, in the above embodiments the heater-mounting surface 16 extends across the inside of the barrel, from one side to the other. However, in alternative embodiments the heater-mounting surface may be formed as a more enclosed channel in which the heater element(s) may be inserted. For example, the heater-mounting surface may have a "U"-shaped cross-section, integrally formed with the external surface by extrusion, and the heater element(s) may be slotted into the inside of the "U".

In the above embodiments a single heater-mounting surface 16 extends across the inside of the barrel. However, in alternative embodiments more than one heater-mounting surface may be provided across the inside of the barrel, from one side to the other. For example, two (or more) separate heater-mounting surfaces may be provided as two (or more) parallel chords extending across the inside of the barrel, integrally formed with the external surface by extrusion. A separate heater element may then be mounted on each of the heater-mounting surfaces, e.g. using respective spring clips or alternative securing means.

In the above embodiments a single heater element 20 is mounted on a single heater-mounting surface 16. However, in alternative embodiments one heater element 20 may be mounted on one side of a heater-mounting surface and another heater element may be mounted on the opposite side of the same heater-mounting surface, e.g. using a respective spring clip on each side, or alternative securing means. In such a manner the heat provided to a given heater-mounting surface may be increased (potentially doubled).

Throughout the description and claims of this specification, the words "comprise" and "contain" and variations of the words, for example "comprising" and "containing", means "including but not limited to", and is not intended to (and does not) exclude other components, integers or steps.

The invention claimed is:

1. A hair styling appliance comprising:

a heater element, wherein the heater element comprises:

a ceramic substrate having a conductive track for generating heat upon application of an electrical current thereto; and an integral temperature sensor that comprises a resistive track, wherein a resistance of the resistive track changes with temperature;

wherein the conductive track, and the resistive track of the integral temperature sensor, are both embedded, one above the other, within a thickness of the ceramic substrate.

2. The hair styling appliance according to claim 1, wherein the conductive track, and the resistive track of the integral temperature sensor, are formed as planar parallel layers embedded within the ceramic substrate.

3. The hair styling appliance according to claim 1, wherein the integral temperature sensor is molecularly bonded to the ceramic substrate.

4. The hair styling appliance according to claim 1, wherein the conductive track, and the resistive track of the integral temperature sensor, extend over an area of the ceramic substrate, and wherein the resistive track of the integral temperature sensor is arranged to provide temperature sensing over the area of the ceramic substrate.

5. The hair styling appliance according to claim 1, further comprising a barrel, the barrel having an external surface and a heater-mounting surface inside the barrel, wherein the heater-mounting surface is integrally formed with the external surface and extends across the inside of the barrel, from one side to the other, when the barrel is viewed in transverse cross-section;

wherein the heater element is mounted on the heater-mounting surface.

6. The hair styling appliance according to claim 5, wherein the barrel further comprises an inner surface, and wherein the hair styling appliance further comprises a spring clip inserted within the barrel, between the inner surface and the heater element, such that the spring clip provides a force for securing the heater element against the heater-mounting surface.

7. The hair styling appliance according to claim 5, wherein at least a 0.6 mm gap is provided between the conductive track and the heater-mounting surface.

8. The hair styling appliance according to claim 1, further comprising:

a current drive unit operable to supply the electrical current to the conductive track of the heater element;

a resistance sensing unit operable to generate a signal representative of, or dependent on, the resistance of the resistive track of the integral temperature sensor; and a control unit to which the current drive unit and the resistance sensing unit are both connected, the control unit being configured to:

cause the current drive unit to supply the electrical current to the conductive track of the heater element;

receive and process the signal generated by the resistance sensing unit, to determine the temperature of the heater element; and adjust the electrical current supplied to the conductive track of the heater element to regulate the temperature of the heater element, such that the heater element reaches and maintains a desired temperature.

9. The hair styling appliance according to claim 8, further comprising a user interface coupled to the control unit and operable to enable a user to specify the temperature to be attained by the heater element.

10. The hair styling appliance according to claim 1, wherein the ceramic substrate is formed of constituent ceramic layers fired together.

11. The hair styling appliance according to claim 10, wherein the conductive track is formed on a first ceramic layer, the resistive track of the temperature sensor is formed on a second ceramic layer disposed on the first ceramic layer, and a third ceramic layer is disposed on the second ceramic layer.

12. The hair styling appliance according to claim 11, wherein the first ceramic layer has a greater thickness than either the second ceramic layer or the third ceramic layer.

13. The hair styling appliance according to claim 11, wherein the third ceramic layer is provided with a set of through-thickness solder pads having electrical connections thereto, wherein a subset of the set of solder pads are connected to mutually-aligned solder pads on the second ceramic layer, and wherein the solder pads on the second ceramic layer are connected to the resistive track of the temperature sensor.

14. The hair styling appliance according to claim 11, wherein the third ceramic layer is provided with a set of through-thickness solder pads having electrical connections thereto, wherein a subset of the set of solder pads are connected through intermediary mutually-aligned through-thickness solder pads on the second ceramic layer to mutually-aligned solder pads on the first ceramic layer, and wherein the solder pads on the first ceramic layer are connected to the conductive track.

15. The hair styling appliance according to claim 11, wherein the first ceramic layer is provided with a set of exposed solder pads to which the conductive track is connected, and via the solder pads, electrical connections are made to the conductive track.

16. The hair styling appliance according to claim 15, wherein the second ceramic layer and the third ceramic layer are shaped so as not to cover the set of solder pads of the first ceramic layer.

17. The hair styling appliance according to claim 11, wherein the second ceramic layer is provided with a set of exposed solder pads to which the resistive track of the temperature sensor is connected, and via the solder pads, electrical connections are made to the resistive track of the temperature sensor.

18. The hair styling appliance according to claim 17, wherein the third ceramic layer is shaped so as not to cover the set of solder pads of the second ceramic layer.

19. The hair styling appliance according to claim 12, wherein the first ceramic layer has a thickness of 0.6 mm, and the second ceramic layer and the third ceramic layer each have a thickness of 0.2 mm.

20. The hair styling appliance according to claim 1, having an external surface via which heat from the heater element is transferred to a user's hair, in contact with the external surface, in use.

21. The hair styling appliance according to claim 1, being selected from a group comprising: a curling tong, a curling wand, a hot iron brush, and a hair straightener.

22. The hair styling appliance according to claim 1, wherein the conductive track, and the resistive track of the temperature sensor, are both at least 0.6 mm inward of outer edges of the heater element.

23. The hair styling appliance according to claim 1, wherein the conductive track is separated by a first distance from a first surface of the heater element;

wherein the resistive track of the temperature sensor is separated by a second distance from a second surface of the heater element, the second surface being opposite the first surface; and wherein the first distance is different from the second distance.

24. A method of manufacturing a hair styling appliance, the method comprising:

forming a heater element for the hair styling appliance by:

forming, in a ceramic substrate, a conductive track for generating heat upon application of an electrical current thereto, and an integral temperature sensor that comprises a resistive track, wherein a resistance of the resistive track changes with temperature;

wherein the conductive track, and the resistive track of the integral temperature sensor, are both embedded, one above the other, within a thickness of the ceramic substrate; and wherein the method further comprises incorporating the heater element into the hair styling appliance.

25. The method according to claim 24, wherein the conductive track, and the resistive track of the integral temperature sensor, are formed as planar parallel layers embedded within the ceramic substrate.

26. The method according to claim 24, wherein the integral temperature sensor is molecularly bonded to the ceramic substrate.

27. The method according to claim 24, wherein the conductive track, and the resistive track of the integral temperature sensor, extend over an area of the ceramic substrate, and wherein the resistive track of the integral temperature sensor is arranged to provide temperature sensing over the area of the ceramic substrate.

28. The method according to claim 24, wherein the hair styling appliance comprises a barrel, the barrel having an external surface and a heater-mounting surface inside the barrel, wherein the heater-mounting surface is integrally formed with the external surface and extends across the inside of the barrel, from one side to the other, when the barrel is viewed in transverse cross-section;

and wherein the method further comprises mounting the heater element on the heater-mounting surface.

29. The method according to claim 28, wherein the barrel further comprises an inner surface, and wherein the method further comprises inserting a spring clip within the barrel, between the inner surface and the heater element, such that the spring clip provides a force for securing the heater element against the heater-mounting surface.

30. The method according to claim 24, further comprising incorporating, into the hair styling appliance:

a current drive unit operable to supply the electrical current to the conductive track of the heater element;

a resistance sensing unit operable to generate a signal representative of, or dependent on, the resistance of the resistive track of the integral temperature sensor; and a control unit to which the current drive unit and the resistance sensing unit are both connected, the control unit being configured to:

cause the current drive unit to supply the electrical current to the conductive track of the heater element;

receive and process the signal generated by the resistance sensing unit, to determine the temperature of the heater element; and adjust the electrical current supplied to the conductive track of the heater element to regulate the temperature of the heater element, such that the heater element reaches and maintains a desired temperature.

31. The method according to claim 30, further comprising incorporating, into the hair styling appliance:

a user interface coupled to the control unit and operable to enable a user to specify the temperature to be attained by the heater element.

32. The method according to claim 24, wherein, when forming the heater element, the conductive track is deposited on a first ceramic layer, the resistive track of the integral temperature sensor is deposited on a second ceramic layer, the second ceramic layer is placed on top of the first ceramic layer, a third ceramic layer is placed on top of the second ceramic layer, and the first, second and third ceramic layers are fired together to form the ceramic substrate.

* * * * *